US007140113B2

(12) United States Patent
King et al.

(10) Patent No.: US 7,140,113 B2
(45) Date of Patent: Nov. 28, 2006

(54) CERAMIC BLADE AND PRODUCTION METHOD THEREFOR

(75) Inventors: Rodney L. King, Denver, CO (US); Theodore C. Crawford, Denver, CO (US)

(73) Assignee: LazorBlades, Inc., Denver, CO (US)

( * ) Notice: Subject to any disclaimer, the term of this patent is extended or adjusted under 35 U.S.C. 154(b) by 231 days.

(21) Appl. No.: 10/475,283

(22) PCT Filed: Apr. 17, 2002

(86) PCT No.: PCT/US02/12380

§ 371 (c)(1),
(2), (4) Date: Apr. 16, 2004

(87) PCT Pub. No.: WO02/083374

PCT Pub. Date: Oct. 24, 2002

(65) Prior Publication Data

US 2004/0163262 A1 Aug. 26, 2004

Related U.S. Application Data

(60) Provisional application No. 60/284,405, filed on Apr. 17, 2001.

(51) Int. Cl.
*B26B 21/58* (2006.01)

(52) U.S. Cl. ..... 30/346.54; 30/350; 76/104.1

(58) Field of Classification Search ..... 76/104.1; 30/346.53, 346.54, 350, 345, 346.58
See application file for complete search history.

(56) References Cited

U.S. PATENT DOCUMENTS 3,349,488 A 10/1967 Craig
3,514,856 A 6/1970 Camp et al.
3,543,402 A 12/1970 Seager
3,926,601 A 12/1975 Hicks, Jr.
3,977,061 A 8/1976 Lindstrom et al.
4,078,338 A 3/1978 Baughcom
4,201,599 A 5/1980 Morgans
4,330,576 A 5/1982 Dodd
4,495,698 A 1/1985 Gerber, Jr.
4,718,200 A 1/1988 Miquelot
4,741,973 A * 5/1988 Condit et al. ..... 428/553
4,787,146 A 11/1988 Gaskins
5,018,271 A 5/1991 Bailey et al.
5,077,901 A 1/1992 Warner et al.

(Continued)

OTHER PUBLICATIONS

Page 78 of Jensen 1987-1988 Catalog, Jensen Tools, Inc., an AXIA Enterprise, located at 7815 S. 46th Street, Phoenix, Arizona 85044-5399.

*Primary Examiner*—Hwei-Siu Payer
(74) *Attorney, Agent, or Firm*—Timothy J. Martin; Michael R. Henson; John W. Carpenter

(57) ABSTRACT

A blade of ceramic material is treated to enhance the strength and sharpness of the cutting edge. In one embodiment, ceramic particles along at least one margin of an edge-forming face are fused, such as by a laser treatment. The edge mardin can have a hard ceramic coating of a different ceramic material such as a nitride of chromium, zirconium, titanium, titanium carbon or boron. The hard ceramic coating can be used alone or in conjunction with the laser treatment. The invention includes the methods of treating the edge, both to form the hard ceramic coating and to fuse the particles by scanning with laser, such as an ultraviolet laser.

26 Claims, 5 Drawing Sheets

U.S. PATENT DOCUMENTS 5,528,833 A * 6/1996 Sakuma ..... 30/260
6,076,264 A * 6/2000 Meckel ..... 30/225
6,090,108 A * 7/2000 McBrayer et al. ..... 606/46
6,151,786 A 11/2000 Hellstern
6,192,591 B1 2/2001 Hellstern
6,555,180 B1 * 4/2003 Hofmeister et al. ..... 427/475

* cited by examiner

CERAMIC BLADE AND PRODUCTION METHOD THEREFOR

FIELD OF THE INVENTION

The present invention generally relates to cutting tools of the type that have a single or a plurality of cutting edges. In particular, the present invention is directed to a ceramic cutting tool having an extremely fine cutting edge. One such blade is a shaving razor blade. The invention also relates to a method for producing a ultra-fine cutting edge on a ceramic material which edge is also extremely durable over time and use.

BACKGROUND OF THE INVENTION

Since human kind first began to employ tools, one of the most versatile and prolific tools has been the knife. Primitive humans used knives for piercing, cutting and scrapping. Here, knives were first formed of a stone material, such as quartz, flint or obsidian. The knife edge was created by pressure-flaking the stone along its crystalline cleavage planes with intersecting planes creating the cutting edge. While such technique resulted in extremely sharp edge, stone knives were brittle such that the edge was easily broken or chipped.

As technological advancement occurred, knives or other cutting blades began to be formed out of metal. Metal was less brittle and more malleable than stone. Thus, metal blades with cutting edges had the advantage of resistance to chipping. However, the cutting edges of metal blades were often not as sharp as stone edges and would tend to become dull with time and use unless resharpened. However, as technology developed into more modern times, the sharpness of metal edges began to approach the sharpness of stone edges; however, dulling remained a problem.

Recent developments in materials science, however, has resulted in high technology ceramic materials which, like their stone cousins, can form a matrix onto which an extremely sharp blade edge may be formed. Ceramic blade edges, however, still are subject to some chipping due to their brittleness. Materials traditionally used for forming ceramic blades include alumina and zirconia. Usually, a blade blank is formed by mixing a ceramic powder with a binder or plastisizer and compressing the mass under high pressure to create a solid cohesive mass. Typical particle sizes for such materials are on the order of 0.5 microns or less. The compressed material is typically fired in a furnace until it is hardened into a cured state. The cutting edge is formed on the material either before or after this hardening step.

In any event, ceramic cutting blades have many advantages over their metal counterparts. In addition to their extremely sharp edge, ceramic cutting blades can be readily sterilized, for example, when these blades are used as medical scalpels. Where employed in industrial applications, such as the semi-conductor industry, there is less risk of contamination from the ceramic material since it is rather benign to the semiconductor doping process. Metal, on the other hand, can contaminate and ruin the semi-conductor materials.

There have been some attempts to advance the art of ceramic blades in recent years. One such example is shown in U.S. Pat. No. 5,077,901 issued Jan. 7, 1992 to Warner et al. In this patent, a ceramic blade and production methodology is described. The blade includes a cutting edge formed by first and second cutting faces oriented at a bevel angle. At least one of the cutting faces includes striations having a grain direction substantially perpendicular to the cutting edge with these striations having a width of between 20 and 40 microns. These striations have benefits including increase blade endurance. Further, micro-chipping of the material is described as causing the material between adjacent striations to slough in a direction perpendicular to the edge. The "pressure flaking" during use tends to increase the sharpness of the cutting edge as opposed to diminishing the sharpness.

Despite the advantages achieved by the ceramic blades in the '901 Patent, there remains a need for increasingly improved ceramic cutting blades. There is a need for ceramic blades that can be used in medical and industrial applications as well as blades that may be used for consumer products, such as razor blades. There is a need for such ceramic blades that have increased sharpness and enhanced durability while at the same time can be produced by a methodology that is cost effective and within the economic reach of the ordinary, average consumer.

SUMMARY OF THE INVENTION

It is an object of the present invention to provide a new and useful ceramic blade having an enhanced cutting edge.

A further object of the present invention is to provide a method for manufacturing ceramic blades which produces a more durable edge while at the same time being cost efficient in implementation.

Still a further object of the present invention is to provide a ceramic blade with a cutting edge that resists chipping or particle dislodgement at the cutting edge margin so as to be highly durable over an extended period of use.

Still a further object of the present invention is to provide a ceramic blade and method of production that may be employed to create cutting edges of a variety of shapes.

Yet a further object of the present invention is to provide a shaving razor blade having an extended useful life.

According to the present invention, then, a blade comprises a ceramic body formed of a selected ceramic material that is a matrix of ceramic particles of a selected particle size. This ceramic body includes a cutting edge defined by at least two converging faces such that the margins of the two faces adjacent to the cutting edge define an edge portion. At least some of the ceramic particles located on the margin of one face which are adjacent to one another have contacting surfaces that are thermally fused together. In addition to or as an alternative to having the ceramic particles thermally fused to one another, a hard ceramic coating formed by a second ceramic material different from the first ceramic material may be formed on the margin of the cutting face adjacent to the cutting edge. The margin may have a width within a range of about 3.0 mm to about 5.0 mm. Moreover, it is desirable that a majority of the adjacent ceramic particles are the margin be fused to one another.

The cutting edge can be formed by two converging cutting faces. In this instance, it is desirable to treat margins of each of the faces adjacent to the cutting edge either by thermally fusing particles together of by providing the hard ceramic coating. In any event, the hard ceramic coating may be chromium nitride, zirconium nitride, titanium nitride, titanium carbon nitride or other coatings as known in the industry.

It is preferred that the ceramic body be formed of a sintered ceramic. The ceramic material may be selected from a group consisting of zirconia, alumina, tungsten carbide and the like. Moreover, these selected particle size is less than about .0.5 micron.

The converging faces may converge at a convergent angle of no more than 60°. Where the blade is to be used as a shaving razor blade, the ceramic body is formed as a plate having a thickness between about 0.1 inch (0.254 mm) and 0.25 inch (0.635 mm). Where a shaving razor blade is formed, the convergences angle is in a range between about 10° and 20° and, preferably, about 14.7°.

In a first method of forming a blade according to the present invention, a production blank is first formed out of a ceramic material. Here again, the ceramic material is formed as a matrix of ceramic particles of a selected particle size. An edge is then formed on the production blank. The method then includes the step of thermally fusing at least some of the ceramic particles that are in contact with one another in a margin of blade adjacent to the edge.

In this method, the production blank may be in the green state, and the step forming the edge is accomplished by green machining the production blank. The method then includes a further step of sintering the production blank. Alternatively, the production blank can be in a green state and is sintered and thereafter the edge is formed by grinding.

In any event, the step of joining the ceramic particles may be accomplished by scanning a margin portion that is adjacent to the edge with a laser beam at a selected wavelength for a selected width as measured from the edge. The selected wavelength may be in the ultra violet range and, according to the preferred embodiment, the selected wavelength is about 280 nm. Also, the margin portion is preferably about 3.5 microns in width and the laser beam has a diameter of the margin portion during the scanning step of about 1.0 microns. Further, the margin portion is scanned with the laser in a zigzag pattern at a rate of about 0.3 to 0.6 inches per second. In the first method, an additional step may be provided wherein a metal coating is deposited on the margin and thereafter the method includes the step of oxidizing the metal coating to produce a hard ceramic layer.

A second method according to the present invention includes the step of producing a production blank again out of ceramic material wherein the ceramic material is formed as a matrix of ceramic particles of a selected particle size. An edge is formed on the production blank. Thereafter, a metal coating is deposited on a margin of the production blank proximately to the edge and thereafter the metal coating is oxidize to produce a hard ceramic layer.

The second method of forming a blade contemplates forming the metal coating out of metal selected from a group consisting of chromium and zirconium. The step of oxidizing the metal coating is preferably accomplished by nitrating the metal coating. In this method, it is preferred that the hard ceramic layer be formed at a thickness of between about 0.7 and 1.0 nm.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention is directed to a method of producing an improved blade edge on a ceramic blade blank or substrate. In addition, the present invention is directed to a ceramic blade having a cutting edge of specific described characteristics that can be produced, for example, by the method described herein. The blades according to the present invention enjoy a wide variety of potential applications including the industrial and medical uses as well as consumer applications. Of particular interest to this invention is a shaving razor blade.

A description of a simplified process according to the present invention is first presented. This is followed by a more detailed description of an expanded process as well as the discussion of the types of blades and cutting edges that may be created by the present invention. Finally, a shaving razor blade incorporating the features of the invention is described.

A. Streamlined Process

Figure 1:
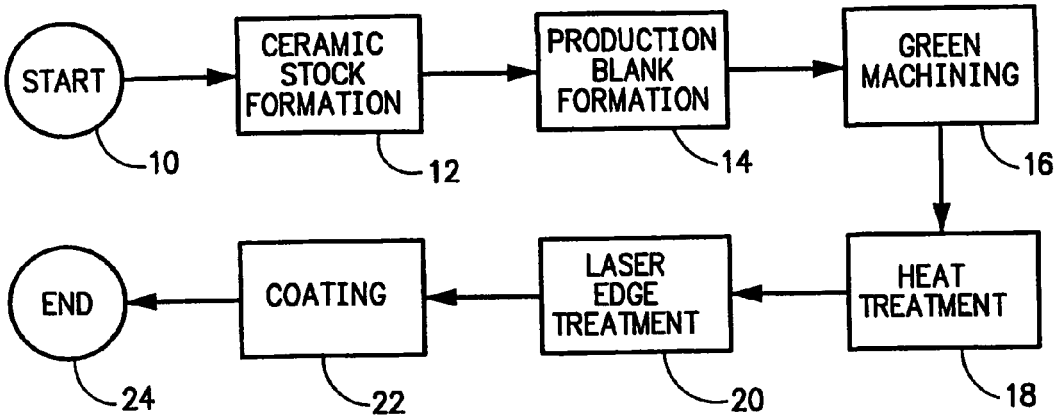
FIG. 1 is a diagrammatic view showing the processing steps of a streamlined method for producing a ceramic blade according to the present invention.

A streamlined process according to a first exemplary embodiment of the methodology of the present invention may be appreciated with reference to FIG. 1. As is shown in this Figure, six fundamental fabrications steps are contemplated. Each of these will be discussed in turn.

1. Ceramic Stock Formation

With reference to FIG. 1, it may be seen that the start of the process begins at reference number 10 and proceeds to a first step of ceramic stock formation at 12. Ceramic stock formation involves the fabrication of the ceramic matrix out of which the blades according to the present method may ultimately be produced. Typically, this matrix is in the form of a raw ceramic sheet that is stiff yet pliable, in a manner not dissimilar from clay. Four primary techniques are known to produce the ceramic matrix which the blades may be formed. These include tape extrusion, dry pressing, slurry and roll compaction.

a. Tape Extrusion

According to the present invention, the preferred method for creating the raw ceramic matrix or sheet is referred to at tape extrusion. First, a selected mixture of ceramic powder is mixed with a binder or plastasizer to form a dough. While zirconia is the preferred ceramic material, it should be understood that other materials as is known in the art may be employed to form the ceramic dough. Examples of these materials include alumina and tungsten carbide. Suitable binders or plastisizers include acetone, MEK (methylketone) and the like, again as is known in the art. The components are placed in a tank and mixed to form a relatively homogenous damp mass that is similar in consistency to a dough-like clay. The mixed mass is taken from the tank and placed in a hopper where it is extruded out of a slit die onto a plastic film (mylar) that is moved along a heated table. The slit of the extruder is parallel to the plane of the table, and, as the mass is extruded into a thin sheet, it passes under a doctor bar to smooth the sheet into the desired thickness. As the sheet is conveyed along the heated table on the plastic film, the solvent binders are cooked off to dry the sheet into a pliable piece that is stiffened yet deformable. The sheet is then cut into desired lengths and hung to dry. This technique is generally preferred where a thin dimensional thickness is desired.

b. Dry Pressing

Another optional technique to form a raw sheet of ceramic material is the dry pressing process. Here, again, the powdered ceramic, such as zirconia or alumunia, is mixed with a binder as discussed above. A selected quantity of this mass is then placed in a pre-formed mold that is in the shape of the product and is subjected to uniform pressure in a range of approximately 500 psi to 10,000 psi to form the sheet. Where a thick product is desired, dry pressing may be preferred over the tape extrusion process, discussed above.

c. Slurry

A third optional technique of forming the mass is called the slurry process. The slurry process is less desirable because it typically cannot be used to form thin parts. Here, a very wet cement-like mass of ceramic and binder is formed, typically using a larger ratio of binder to ceramic powder to that used in the dry press or tape extrusion processes. The wet cement-like mass is placed in a form and the excess material is troweled off. The resulting product is then dried to form a raw ceramic sheet.

d. Roll Compaction

A final method of forming the raw ceramic sheet stock is called roll compaction. Roll compaction is identical to tape extrusion, discussed above, but employs a pressure roller downstream of the doctor bar. The pressure roller is set further to apply a normal force on the extruded sheet to compress the extruded sheet at a desired thickness as a sheet moves thereunder while being conveyed by the moving, heated table. Roll compaction is sometimes desirable because it can produce ceramic sheets faster at a higher yield and have less edge margin curvature than as sometimes occurs with tape extrusion.

2. Production Blank Formation

In the generalized process, the blade blank formation step 14 is accomplished in any manner wherein a blade blank is cut from a stock of material in its green state, that is, uncured. Thus, for example, an individual blade may be formed and subjected to the further processing steps, discussed below, as is known in the art.

3. Green Machining

Figure 6:
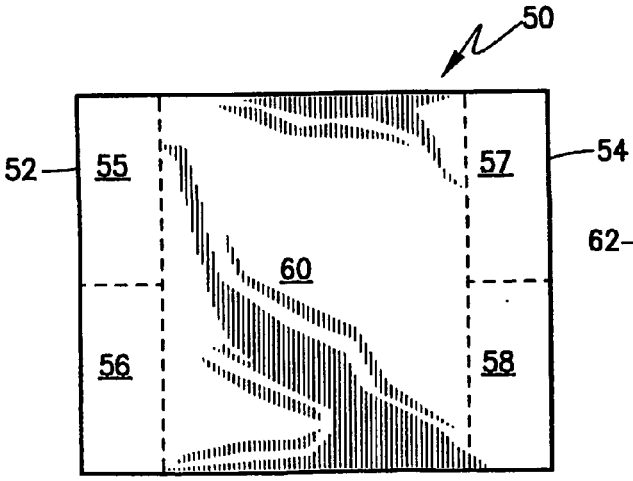
FIG. 6 is a top plan view showing a gross production blank according to the present invention.
Figure 7:
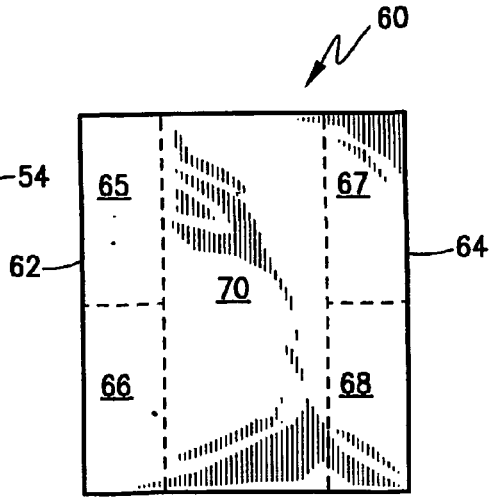
FIG. 7 is a top plan view of the gross production blank shown in FIG. 6 having a plurality of blade blanks removed therefrom.
Figure 8:
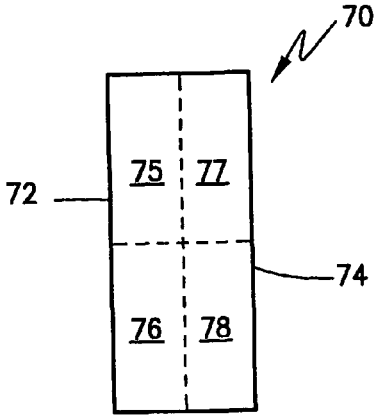
FIG. 8 is a top plan view of the gross production blank of FIGS. 6 and 7 showing additional production blanks removed therefrom.

After a production blank is formed, it undergoes a green machining step, at 16 in FIG. 1, wherein a cutting edge is formed on the pre-fired blank. For example, with reference to FIG. 6, it may be seen that cutting edges 52 and 54 are formed on pre-fired blank 50. Individual blades 55–58 are then cut from pre-fired blank 50 to result in pre-fired blank 60 shown in FIG. 7. Cutting edges 62 and 64 are cut on pre-fired blank 60 to form blades 65–68 which may be laser cut from pre-fired blank 60 to form pre-fired blank 70. Pre-fired blank 70, as is shown in FIG. 8, may then have cutting edges 72 and 74 cut thereon and bladse 75–78 are laser cut therefrom. The step of green machining is accomplished by using an abrasive grinding wheel such as diamond or various ceramic materials as is known in the art. A grinding wheel having an approximate eight hundred grit is typically used. If too rough of a grit is employed, a fine enough edge is difficult to achieve. On the other hand, if too fine of a grit is used, the abraded ceramic will too rapidly plug the grinding wheel. In any event, it is desired in the generalized process to form a sharp enough edge under the green machining step so that no further edge polishing is necessary.

4. Heat Treatment

After the individual blade is green machined, it is subjected to the heat treatment to sinter the ceramic material, as illustrated at 18 in FIG. 1. Here, a plurality of ceramic blocks are placed on a traveling car or carriage, typically mounted to a chain drive which passes through an oven. An initial layer of ceramic blocks is placed and an ensemble of individual blades is then placed on the initial layer of ceramic blocks. A second layer ceramic blocks is then stacked on top of the first layer of blades and a second layer of blades is placed on the second layer of ceramic blocks. This layering continues for approximately six to eight layers with the final layer also being a cap of ceramic blocks. The loaded carriage is then towed through a furnace which is typically at a temperature of approximately 3000° F. The dwell time for the blades in the furnace is approximately four to twelve hours until they are cured.

The result of the heat treating step is a hard blade that is no longer pliable, although, when a ceramic matrix of zirconia is employed to form the product, the blade may still slightly flex. Further, depending upon the degree of fineness of the green machining, the blade either has a cured edge or can be finished enough for certain applications, such as those in industrial processes.

Figure 2:
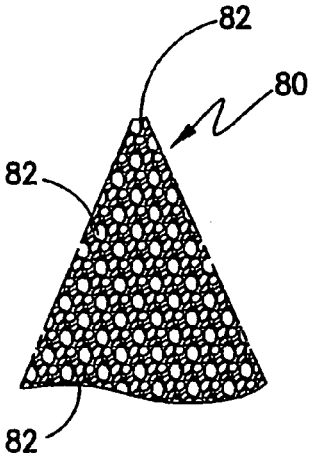
Fig.2 (PRIOR ART)
FIG. 2 is a diagrammatic cross-section showing the particles of a compressed ceramic blade edge according to the prior art.
Figure 3:
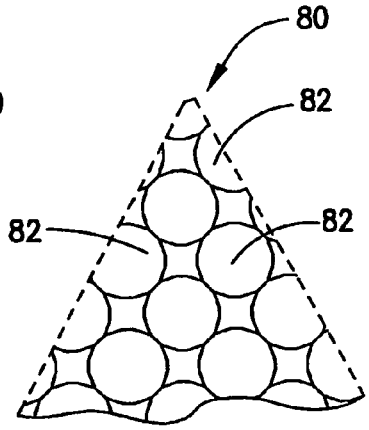
Fig.3 (PRIOR ART)
FIG. 3 is an enlarged view of the distal cutting edge of a prior art ceramic blade.
Figure 4:
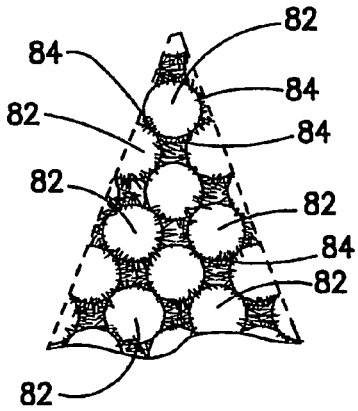
FIG. 4 is a diagrammatic view, in magnified perspective, showing the distal cutting edge of a ceramic blade according to the present invention.

5. Laser Edge Treatment (FIGS. 2–4)

An important processing step in one embodiment of the present invention is the treating of the centered blade edge by means of a laser scan, as depicted at 20 in FIG. 1 and in greater detail below with respect to FIG. 20. With reference to FIGS. 2 and 3, it may be seen that an edge 80 of a typically prior art blade is formed of a plurality of ceramic particles 82 which are packed together in a dense matrix. With reference to FIG. 3, it may be seen that these particles 82 are individual particles that are not tightly bonded together by the sintering process. Accordingly, and as is the case in prior art ceramic blades, the edge 80 shown in FIGS. 2 and 3 can deteriorate as a result of individual particles 82 becoming dislodged during use. As the particles 82 are abraded away, the cutting edge becomes duller and duller.

To eliminate this, the present invention employs a laser edge treatment in order to provide a microscopic melt on the individual ceramic particles located on the extreme edge of the blade. This is referred to herein as thermal fusing. By this it is meant that the degree of melting is sufficiently more than that which occurs during sintering such that the particles are intimately bonded together. The result is illustrated in FIG. 4 where it may be seen that particles 82 have melted regions 84 on the microscopic level. When slightly melted together, it has been found that the particles adhere and do not become easily dislodged thereby providing an extremely long lasting and durable cutting edge.

Numerous parameters can effect this laser edge treatment. Such parameters include the wavelength of the laser, the wattage of the laser, the thickness of the edge to be treated, the color of the ceramic material, the travel rate of the laser across the edge, the beam width of the laser and the angle of the laser. It has been found that a high energy, high intensity laser is most suitable for flash forming the slightly melted edge. Preferably, an ultra-violet laser is employed. It has been found that a longer wavelength laser will cause cracking of the edge which may be the result of thermal expansion of a ceramic particles. On the other hand, an intense ultra-violet laser will cause localized rapid heating at the surface of the particles allowing them to bond while minimizing any expansion.

Figure 21:
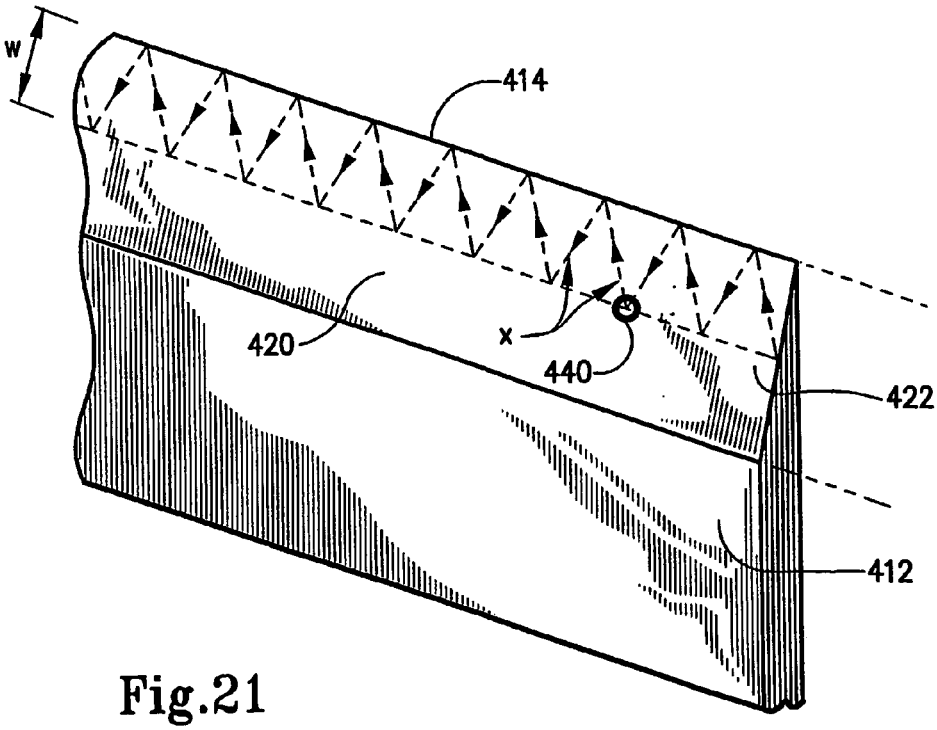
FIG. 21 is a perspective view of a sintered production blank used to form the razor blade of FIG. 18 illustrating the scanning pattern for the laser beam used to conduct such thermal fusing step.

It has been found that a suitable laser for this laser edge treatment is an ultra-violet laser having a wavelength of approximately 280 nanometers with a hundred to five hundred watt power. For a one and a quarter inch blade (1¼") it is scanned with a travel rate of approximately 0.1 seconds per inch. Using the zigzag pattern described with respect to FIG. 21, it is possible to scan at a rate of 0.3 to 0.6 inches per second.

6. Coating

After the laser edge treatment is concluded, the resulting edge receives a hard ceramic coating using a sputter-like process, as noted at 22 in FIG. 1. Here, a thin layer of chromium nitride or zirconium nitride is on the extreme cutting edge. This can be accomplished by placing an ensemble of blades in a vacuum and depositing chromium or zirconium metal on the blade edge under vacuum. The metal is then undergoes an oxidizing reaction, for example, by introducing nitrogen gas is then introduced into the coating chamber so that a chromium nitride or zirconium nitride coat having a thickness of approximately seven to ten angstroms is placed on the edge. This oxidation step is called "nitriding". The process is then completed as depicted at 24 in FIG. 1.

While zirconium nitride and chromium nitride are demonstrated to be effective, other hard ceramic coatings currently known in the industry or hereinafter developed may be useful, as well. For example, titanium nitride, titanium carbon nitride and boron nitride coatings would appear to be suitable.

B. Expanded Process (FIG. 5)

Figure 5:
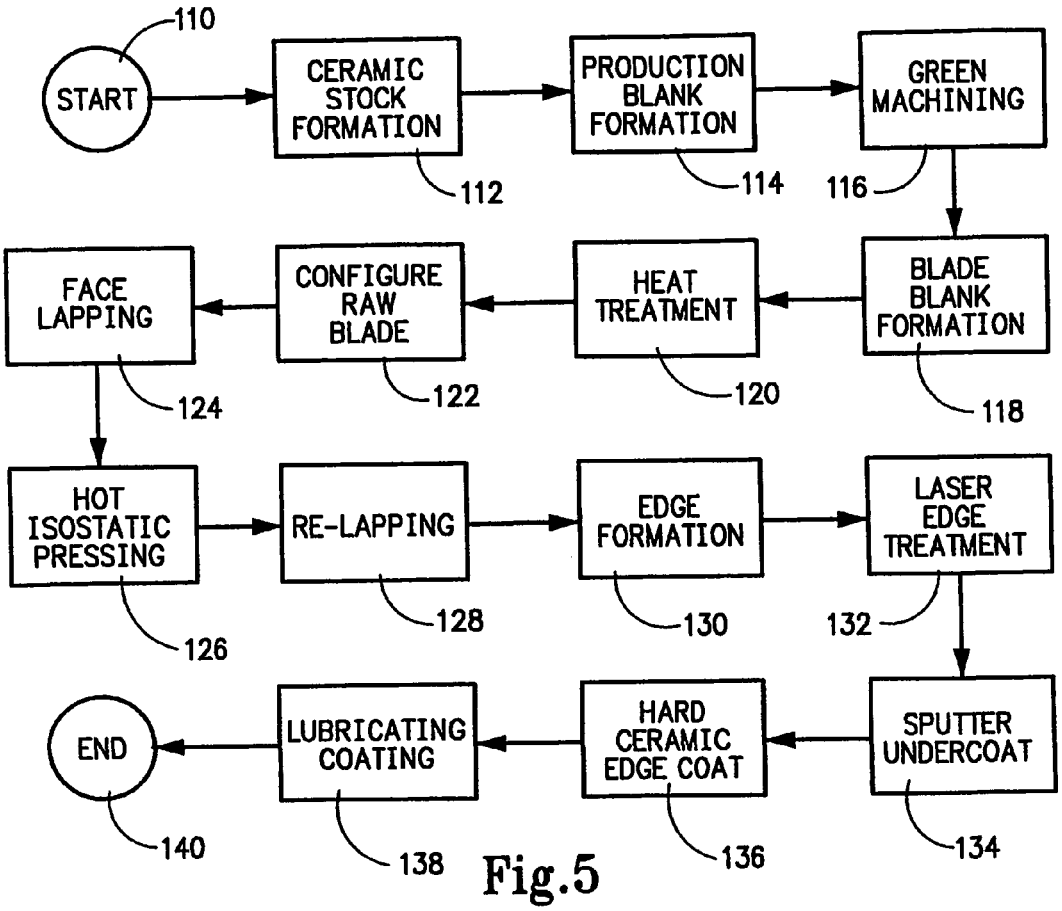
FIG. 5 is a block diagram showing the processing steps according to an expanded fabrication process of the present invention.

With reference now to FIG. 5, an expanded manufacturing process for blades according to the present invention is diagrammed. Numerous of these steps are similar to the generalized process so need not be discussed again. The process starts at step 110 and a first step is that of ceramic stock formation, at 112.

1. Ceramic Stock Formation

Ceramic stock formation step 112 is identical to that with respect to ceramic stock formation step 12, discussed above so that discussion is not again repeated.

2. Production Blank Formation

The step of the production blank formation at 114, is the same as the production blank formation step 14, discussed above.

3. Green Machining

The green machining step at 116 is the same as the green machining step 16 discussed at A.3 above so that discussion is not again repeated.

4. Blade Blank Formation

Regardless of the method of forming the raw ceramic sheet stock, the resulting sheet stock is typically a pliable sheet of a consistency similar to chewing gum. This sheet must then be formed into a production blank, as at 118 in FIG. 5, which is normally accomplished, as is known in the art, by a laser cutting process. As is shown in FIG. 5, the production blank formation occurs as step 118 wherein a laser beam is used to cut the ceramic sheet, for example, into four to five inch rectangular blanks that may be referred to as a "pre-fired blank". The cutting of the ceramic sheet is usually accomplished by either a carbon dioxide (CO2) laser or a YAG (yttrium aluminum garret) laser.

5. Heat Treatment

The heat treatment step 120 is the same as the heat treatment steps 18, discussed above so that this step is not again described.

6. Configure Raw Blade

Figure 9:
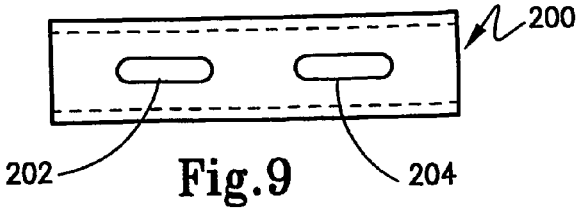
FIG. 9 is a top plan view showing a razor blade according to the present invention.

With reference again to the expanded process of FIG. 5, the expanded process include a step 122 of configuring the raw blade. Here, any desired contouring of the blade may be undertaken. For example, with reference to FIG. 9, a razor blade 200 is shown wherein typically, holes 202 and 204 (or other configuration) is accomplished either by machining the hole or configuration or by laser cutting the hole or configuration.

7. Face Lapping

In the expanded process, an optional face lapping step is performed after the blade is configured. The purpose of the face lapping step is to grind the blade into a desired thickness. As is known in the art, two large counter-rotating disks are employed in a face lapping process. The blades are placed flat on a surface, typically in a carrier that may be held onto the lower counter-rotating disk, for example, by suction holes. The carrier is then inserted between the counter-rotating wheels and a diamond and/or ceramic slurry is introduced so that the surfaces of the blades may be ground to a desired thickness. Typically, in this step, a typical blade of approximately 0.080 inches in thickness is ground to a thickness of approximately 0.075 inches. While it often suitable to face lap just a single surface of the blade, it should be understood that in some applications, both faces of the blade may be subjected to the face lapping process.

8. Hot Isostatic Pressing

Another optional step in the expanded process is subjecting the blades to a hot isostatic pressing or "hipping". The purpose of hipping is to remove flaws that may be internal to the ceramic matrix. Because of the powder formation, there can occur a void in the material. Even though the material, at this point, is typically 99.4% compacted, hot isostatic pressing can increase the compaction to 99.9%.

Hot isostatic pressing, noted at 126 in FIG. 5, is accomplished by placing the center blade in a rack that is provided with a matrix of tiny holes. The plurality of blades are then inserted in a gas or liquid environment under tremendous pressure. Typical pressures for hot isostatic pressing are in the range of about five thousand to thirty-five hundred thousand (5,000 to 35,000) psi range. If desired, hot isostatic pressing can take place at room temperature, but it is preferred that the temperature be either elevated by an auxiliary heater or allowed to elevate as a result of the application of pressure to a temperature to approximately 200° Fahrenheit. Hot isostatic pressing need only be applied for a relatively short duration, on the order of one (1) minute, in order to achieve the desired increase in compaction.

9. Re-lapping

When the center blade has been subjected to a hipping treatment, the pressure can sometimes slightly distort the faces of the blade. Accordingly, the faces may be re-lapped, as shown at 128 in FIG. 5, to result in flat blade surfaces that are parallel to one another. This re-lapping step is accomplished in the manner identically to that discussed with respect to the step of face lapping, above.

10. Edge Formation

In circumstances where the green machining has not been sufficient to form the desired shortness of the blade, the blade may undergo a bevel edge formation, as illustrated at 130 in FIG. 5. This polish edging is conducted as is known in the art on grinding wheels of various coarseness. An initial bevel is placed using an 8,000 grit diamond wheel followed by beveling with a 12,000 grit diamond wheel and finally, beveling with a 20,000 diamond grit wheel. Depending upon the shape of the wheel and the angle at which the blade is placed on the wheel and the orientation of the blade with respect to the wheel, a variety of different bevels can be achieved. Typically, the blade is placed against the cylindrical surface so that the blade is tangent to the wheel. The plane of the blade is canted at an angle of approximately 6° to 45° with respect to the axis of rotation of the wheel to accomplish the bevel. It is possible to put both convex and concave bevels, compound bevels and straight bevels on a blade edge, as described more thoroughly below.

11. Laser Edge Treatment

After the edge formation, the beveled edge in the expanded process is subjected to a laser edge treatment at 132. This laser edge treatment is identical to the laser edge treatment 20 discussed above so that discussion is not again repeated.

12. Sputter Undercoating

As noted above with respect to the streamlined process, it is desired that the blade edge receive a ceramic coating. To enhance the ceramic coating, it is first desirable to provide a sputter undercoat of pure metal, as noted at 134 in FIG. 5. Prior to sputter undercoating the edge margin however, it is helpful to clean the blade. This may be accomplished by soaking the blade in a solvent, such as isopropyl alcohol. After soaking, the blade may be placed in a vacuum chamber and heated to burn off the solvent.

After the cleaning solvent is removed, the blade receives the metal undercoat. Here, the metal used for the sputter undercoat is selected to match the desired hard ceramic coating to be subsequently applied. For example, if a chromium nitride coating is desired, the edge of the blade may first be sputtered with pure chromium so that a thin layer chromium metal is deposited directly onto the blade. On the other hand, if a zirconium nitride ceramic coating is desired, the edge is sputtered with zirconium. The purpose of the metal undercoating is to make the blade edge conductive thereby to cause a higher adhesion of the hard ceramic coating in a subsequent process. The sputter undercoating is accomplished by a standard vacuum sputtering process with the metal coating be placed at a thickness of approximately 2–3 angstroms on the blade edge.

13. Hard Ceramic Edge Coat

The hard ceramic edge coating according to the expanded process is similar to that discussed above with respect to the streamline process and occurs at 136 in FIG. 5. Here, the blade having the metal sputter undercoating is placed in vacuum. Metal that is the same as the undercoating provides metal vapor source and nitrogen gas is introduced into the deposition chamber. The nitrogen gas reacts with the metal vapor and deposits as the hard ceramic coating directly on the metal undercoating at a thickness of 7 to 10 Angstroms. Here, again, other hard ceramics might be employed, such as, titanium nitride, titanium carbon nitride and boron nitride.

14. Lubricating Coating

After finishing the blade with a hard ceramic edge coat, in step 136, it is desired to apply a flourine based lubricating coating onto the edge to reduce friction during use. One such coating material is a dry film material sold under the name KRYTOX® by the E.I. du Pont de Nemours & Company of Wilmington, Del. Here, the flourine base coating is simply sprayed as a film onto the edge, as depicted at 138 in FIG. 5. At this point the process ends at 140.

C. Shapes of Blades

Figure 11:
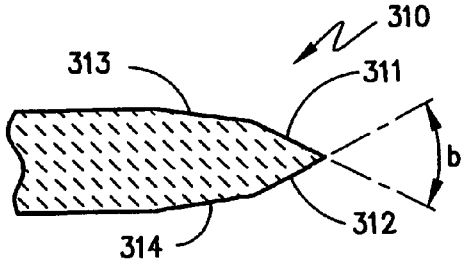
FIGS. 10 through 18 depict the distal cutting edge of various blades implementing the methodology of the present invention.
Figure 10:
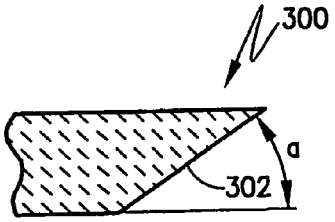

As noted above, a variety of different bevels may be obtained. These bevels are shown in FIGS. 10–17 which represents cross-sections of the extreme blade edge. In FIG. 10, blade 300 is shown to have a single bevel 302 formed at an approximate angle "a" of about 40°. In FIG. 11, blade 10 has a first pair of faces 311 and 312 formed at an angle "b" of approximately 60° with respect to one another. Face 311 is joined to bevel face 313 at a large acute angle of approximately 170°. Likewise, bevel face 314 is formed at a large obtuse angle of about 170° to face 312.

Figure 13:
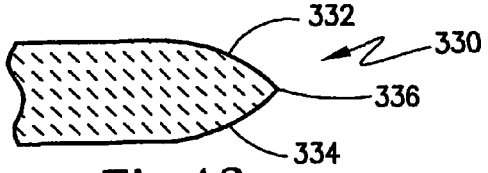
Figure 12:
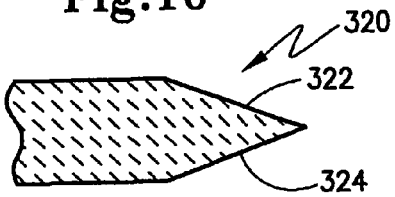
Figure 14:
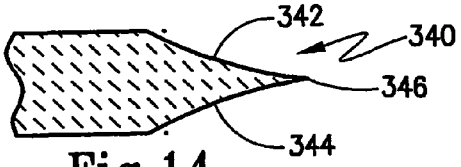

In FIG. 12, blade 320 is formed having a double bevel with faces 322 and 324 being formed at an angle of approximately 45° with respect to one another. In FIG. 13, blade 330 is formed by having a pair of convex bevels 332 and 334 forming edge 336. In FIG. 14, blade 340 is shown wherein a pair of concave bevels 342 and 344 form a thin sharp edge 346.

Figure 15:
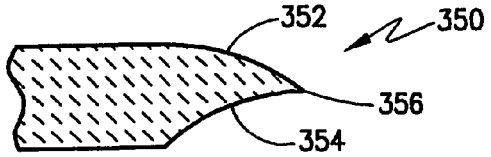
Figure 17:
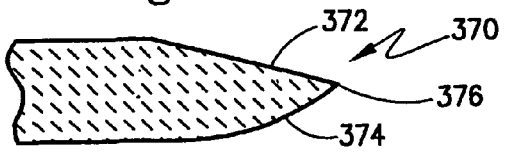
Figure 16:
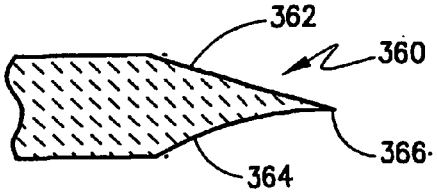
Figure 18:
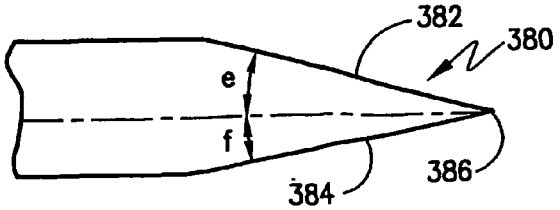

FIG. 15 illustrates yet another bevel configuration. Here, blade 350 has an edge 356 formed by a convex bevel 352 and a concave bevel 354. Turning to FIG. 16, blade 360 has an edge 366 formed by a flat face 362 and a concave bevel 364. FIG. 17 shows a blade 370 having an edge 376 formed by a flat face 372 and a convex bevel 374. Finally, FIG. 18 shows a blade 380 having an edge 386 formed by flat cutting faces 382 and 384. Here it may be noted that the faces 382 and 384 are cut at angles that are not symmetric; that is, angle "e" and "f" are different.

D. Exemplary Shaving Razor Blade

The above described methods may be employed to create a wide variety of blades for different applications including applications in the medical field, industrial field and consumer products field. One such example of blade according to this invention is a shaving razor blade that has been found to have a substantially extended usable lifetime. This blade is best illustrated in FIG. 19 in the form of a ceramic blade 410 formed of a matrix of ceramic particles having a particle size in a range less than about 0.5 microns.

Blade 410 has a ceramic body 412 that terminates in the cutting edge 414. Ceramic body 12 is formed as a flat plate having a thickness "t" of between about 0.002 inch (0.050 mm) and 0.025 inch (0.635 mm). Here, it is preferred that the blade be extruded to this thickness as opposed to face lapping. In order to form edge 414, a cutting face 420 is created on a portion of the rectangular ceramic body 412. This edge can be ground in any manner as described above. Cutting edge 414 is formed by the convergence of a cutting face 420 with the side surface 416 of ceramic body 412, although the cutting edge could be formed by two converging cutting faces. Cutting face 420 is formed at small acute angle "c" that is within a range of about 10° to 20° but, in this embodiment, may be at an convergent angle of about 14.7°.

Figure 19:
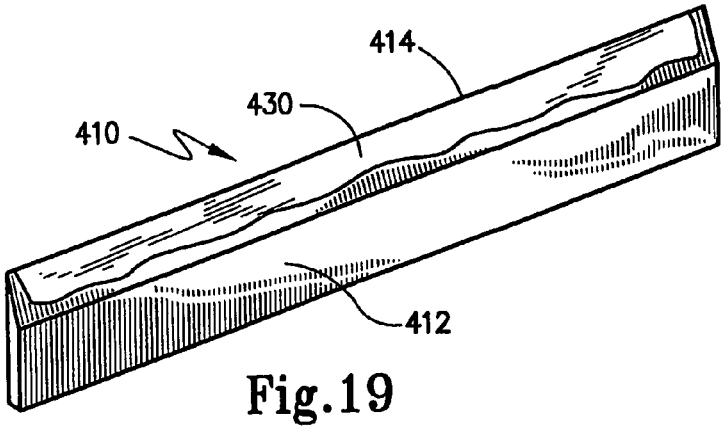
FIG. 19 is a perspective view of a shaving razor blade as an exemplary embodiment of ceramic blade and production method according to this present invention.
Figure 20:
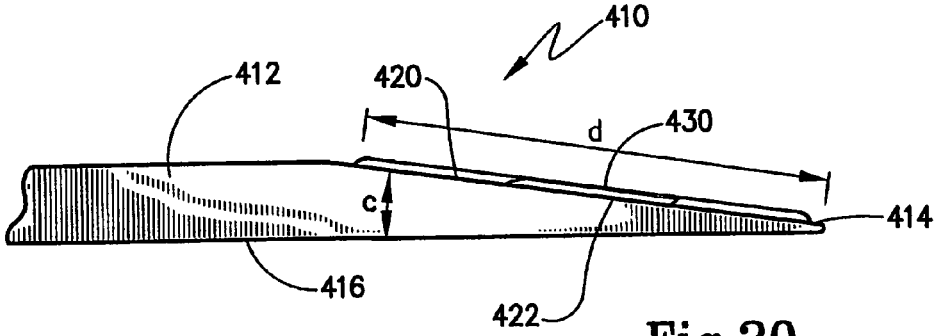
FIG. 20 is a side view in elevation showing the cutting face and cutting edge of the shaving razor blade of FIG. 18.

As is seen in FIGS. 19 and 20, a hard ceramic coating 430 extends for a distance "d" from cutting edge 414 along the margin 422 of cutting face 420. The fabrication method of hard ceramic coating 430 is described more thoroughly below. With this method, the distance "d" would ordinarily be the entire width of the bevel. With respect to blade 410, this hard ceramic coating is a nitride of chromium or zirconium.

Prior to creating the hard ceramic coating 430, however, it is desirable that shaving razor blade 410 undergo a thermal fusion step to thermally join at least some but preferably a majority of the ceramic particles that are in adjacent contract to one another along contact areas in margin 422. This is accomplished by a laser edge treatment that may be more fully appreciated in reference to FIG. 21. Here, it may seen that the method of thermally fusing the ceramic particles together is accomplished by scanning a laser beam, represented at 440 in a zigzag path along a portion of margin 422 that is adjacent to edge 414.

The laser beam 440 preferably has a spot size that is defined by its diameter at the margin portion 422. This spot size is about 1.0 micron in diameter. The width "w" of the scanned surface is about 3.5 microns in width, and the scanning step is done at a zigzag pattern wherein the angle "x" between the zigzag lines is about 45°. the selected wavelength of the laser beam is in the ultra violet range, preferably about 280 nanometers, and the scanning is accomplished at a rate of about 0.3 to 0.6 inches per second. The laser employed in this step for producing blade 410 is a 500 watt laser. As before, It is important in performing this step that the margin 422 not be subjected to excessive heat build up since the thermal fusing is done on a very localized area during the scan.

Figure 22:
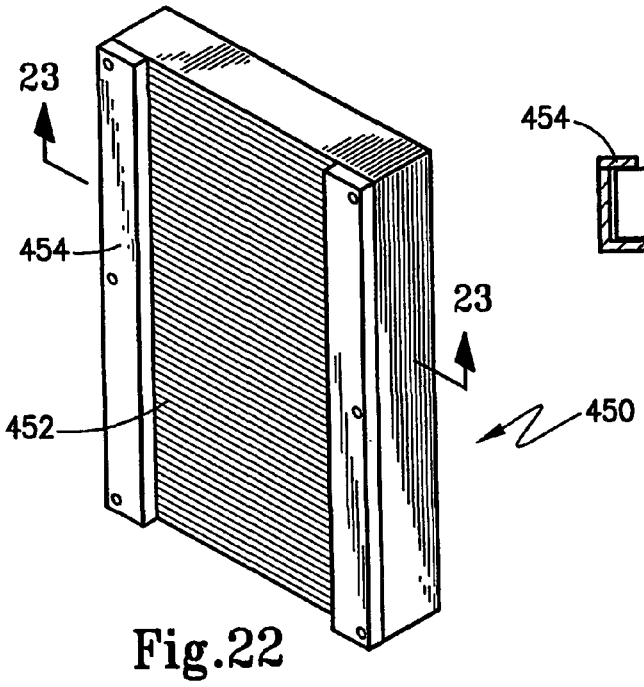
FIG. 22 is a perspective view of a stacked array of a plurality of shaving razor blades in a holder used in the step of forming a hard ceramic coating according to the method of the present invention.
Figure 23:
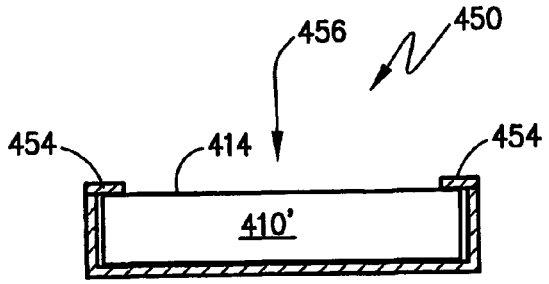
FIG. 23 is a cross sectional view taken about lines 23—23 of FIG. 22.
Figure 24:
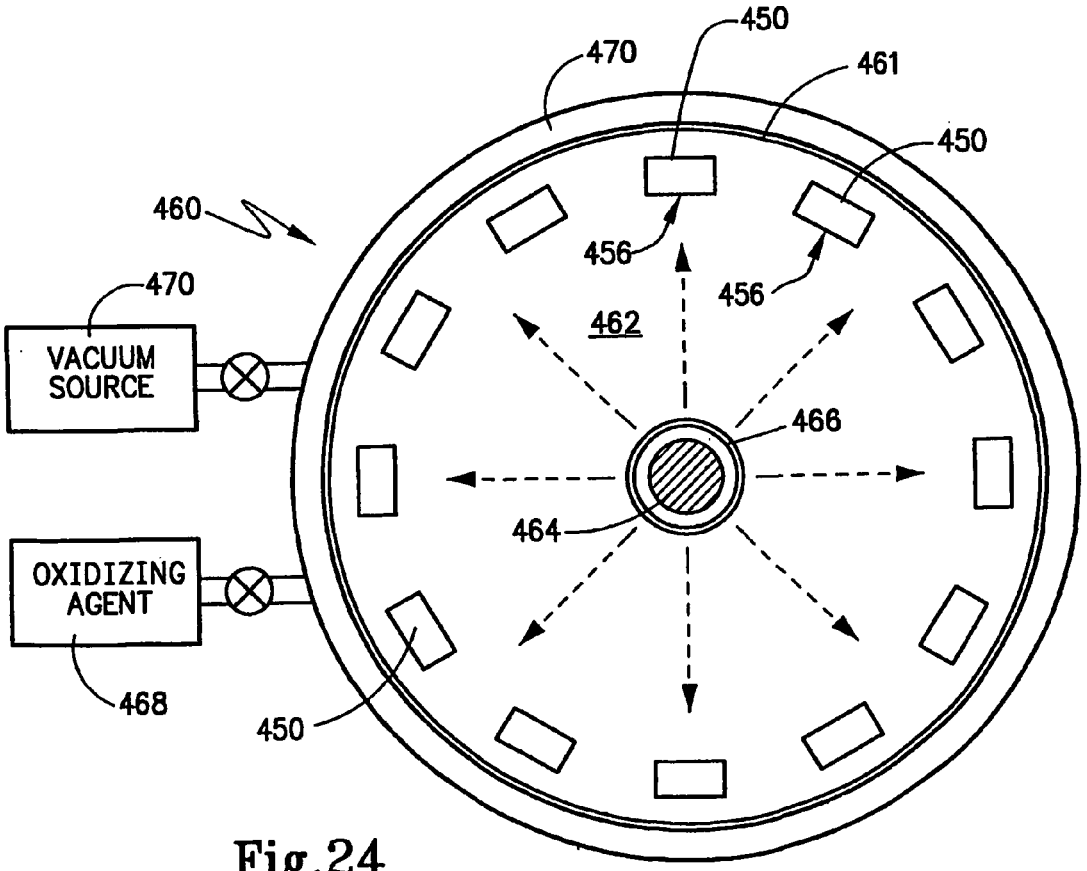
FIG. 24 is a diagrammatic view showing a vapor deposition chamber used to produce the hard ceramic coating for the blades and methods of the present invention.

As noted above, it is desirable to produce a hard ceramic coating 430 on margin 422 of cutting face 420. This processing is illustrated in FIGS. 22–24. In FIGS. 22 and 23, it may be seen that a holder 450 receives a stacked array 452 of individual blades 410' that have not yet had the hard ceramic coating placed thereon. Blades 410', however, do have a cutting edge formed and, if desired for the particular application, have been subjected to the thermal fusing step described with respect to FIG. 21. In any event, holder 450 includes a pair of removable flanges 454 that retain blades 410' in the interior thereof with the cutting edges 414 facing opening 456 so that the cutting edges 414 are exposed.

A plurality of loaded holders 450 are placed in a vapor deposition unit, such as sputtering device 460 as illustrated in FIG. 24. Holders 450 are placed around the perimeter region of chamber 461 in the interior 462 thereof such that openings 456 face radially inwardly. A bar 464 of source metal is located axially in the center of sputtering device 460 and this metal may be, for example, zirconium or chromium. An arc coil 466 extends around the bar of source material 464 in order to provide an electric discharge to vaporize the source metal.

Sputtering device 460 is connected to a vacuum source 470 so that chamber 461 is evacuated. Arc coil 466 is energized so that metal particles migrate radially from the bar source material 464 to impact onto the edges 414 of each of the blades 410' and holders 450. A magnetic array 470 may be provided to enhance the sputtering process.

It should be understood that the structure and design of sputtering device 460 is existing equipment and does not form part of the present invention. However, it is desirable according to this invention that a metal coating corresponding to hard ceramic coating 430 be formed on each cutting face of blades 410' adjacent the respective edge 414 thereof. This metal coating is formed at a thickness of approximately 0.7 to 1.0 nanometers. Also, as this coating is being formed, the interior of chamber 461 is exposed to an oxidizing agent from oxidizing agent source 468. This oxidizing agent is preferably nitrogen that, upon introduction into chamber 461, reacts with the metal particles being sputtered onto cutting faces 420. Accordingly, a reduction/oxidization reaction occurs that converts the metal particles, such as chromium or zirconium, into a chromium nitride or zirconium nitride, respectively. A resulting hard ceramic layer having a width "d" corresponding to the bevel width, is deposited on the metal undercoating at the desired thickness of 0.7 to 1.0 nanometers.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

We claim:

1. A blade comprising a ceramic body formed as a matrix of ceramic particles of a selected particle size of at least one selected ceramic material, said ceramic body including a cutting edge defined by at least two converging faces such that margins of said two converging faces adjacent to the cutting edge define an edge portion for said blade and wherein at least some of said ceramic particles located on one margin and adjacent to one another have contacting surfaces that are thermally fused to one another.

2. A blade according to claim 1 wherein the ceramic body is a sintered ceramic material.

3. A blade according to claim 1 wherein the ceramic material is selected from a group consisting of zirconia, alumina, and tungsten carbide.

4. A blade according to claim 1 wherein the selected particle size is in a range of less than about 0.5 microns.

5. A blade according to claim 1 wherein said ceramic body is formed as a flat plate having a thickness of between about 0.002 inch (0.050 mm) and 0.025 inch (0.635 mm).

6. A blade according to claim 1 wherein the margins of said converging faces converge at a convergence angle of no more than 60°.

7. A blade according to claim 6 wherein the convergence angle is in a range of between about 10°and 20°.

8. A blade according to claim 7 wherein the convergence angle is about 14.7°.

9. A blade according to claim 1 wherein said margin has a width within a range of about 3.0 micron to 5.0 micron.

10. A blade according to claim 1 wherein a majority of adjacent ones of the ceramic particles on said one margin are thermally fused to one another.

11. A blade according to claim 1 wherein at least some of said ceramic particles on each of the margins of said converging faces are thermally fused to adjacent ceramic particles on each respective margin.

12. A blade according to claim 1 including a hard ceramic coating formed on said one margin.

13. A blade according to claim 12 wherein said hard ceramic coating is a nitride of chromium, zirconium, titanium, titanium carbon or boron.

14. A blade according to claim 12 including a metal undercoating between said margin and said hard ceramic coating.

15. A method of forming a blade, comprising:

(a) producing a production blank out of a ceramic material wherein the ceramic material is formed as a matrix of ceramic particles of a selected particle size;

(b) forming an edge on said production blank;

(c) in a margin of said blade that is adjacent to the edge, joining at least some of the ceramic particles that are in adjacent contact with to one another along contact areas by thermally fusing at least some of said ceramic particles together along their respective contact areas.

16. A method of forming a blade according to claim 15 wherein said production blank is in a green state, wherein the step of forming the edge is accomplished by green machining said production blank and including the step of sintering said production blank.

17. A method of forming a blade according to claim 15 wherein said production blank is in a green state and including the step of sintering said production blank and thereafter forming the edge by grinding.

18. A method of forming a blade according to claim 15 wherein the step of joining at least some of said ceramic particles is accomplished by scanning a margin portion that is adjacent to the edge with a laser beam at a selected wavelength for a selected width as measured from the edge.

19. A method of forming a blade according to claim 18 wherein the step of joining is accomplished by said laser beam at a wavelength that is in the ultraviolet range.

20. A method of forming a blade according to claim 19 wherein the step of joining is accomplished by said laser beam at a wavelength that is about 280 nanometers.

21. A method of forming a blade according to claim 18 wherein the edge is formed at a cutting angle of about 15 degrees.

22. A method of forming a blade according to claim 18 including a step of depositing a metal coating on the margin and thereafter depositing a hard ceramic layer on top of the metal coating.

23. A method of forming a blade according to claim 18 wherein the step of joining is accomplished by scanning a margin portion that is about 3.5 microns in width with said laser beam.

24. A method of forming a blade according to claim 18 wherein the step of joining is accomplished by scanning with said laser beam that has a diameter at the margin portion that is about 1.0 micron.

25. A method of forming a blade according to claim 24 wherein the scanning of the margin portion is done in a zig-zag pattern.

26. A method of forming a blade according to claim 25 wherein the scanning of the margin portion is done at a rate of about 0.3 to 0.6 inches per second.

* * * * *